US011324302B1

(12) United States Patent
Heilman

(10) Patent No.: US 11,324,302 B1
(45) Date of Patent: May 10, 2022

(54) CONTAINER WITH INTEGRATED DISPENSER AND APPLICATOR

(71) Applicant: Katrina Joy Heilman, Portland, OR (US)

(72) Inventor: Katrina Joy Heilman, Portland, OR (US)

(73) Assignee: Brushi LLC, Portland, OR (US)

( * ) Notice: Subject to any disclaimer, the term of this patent is extended or adjusted under 35 U.S.C. 154(b) by 0 days.

(21) Appl. No.: 17/184,540

(22) Filed: Feb. 24, 2021

(51) Int. Cl.
*A45D 34/04* (2006.01)
*A45D 40/26* (2006.01)
*A46B 11/00* (2006.01)

(52) U.S. Cl.
CPC ..... *A45D 34/042* (2013.01); *A45D 40/262* (2013.01); *A46B 11/0041* (2013.01); *A46B 11/0062* (2013.01); *A46B 11/0089* (2013.01); *A46B 11/002* (2013.01); *A46B 11/0086* (2013.01); *A46B 2200/1046* (2013.01)

(58) Field of Classification Search
CPC ..... A46B 11/0041; A46B 11/0062; A46B 11/0089; A46B 2200/1046; A46B 11/00; A46B 11/0003; A46B 11/0006; A46B 11/001; A46B 11/002; A46B 11/0065; A46B 11/0086; A45D 34/042; A45D 40/262; A45D 34/00; A45D 2200/10; A45D 2200/054; A45D 2200/05
USPC ..... 401/183–186, 280, 281, 291
See application file for complete search history.

(56) References Cited

U.S. PATENT DOCUMENTS 2,630,594 A 3/1953 Fisher
2,766,472 A * 10/1956 Durrett ..... A46B 11/0079 401/281
2,827,650 A * 3/1958 Morrill ..... B65D 47/263 401/186
3,100,315 A * 8/1963 Laxalt ..... A45D 33/02 401/175
3,390,941 A * 7/1968 Weber ..... A47L 23/05 401/205
4,071,300 A * 1/1978 Nichols ..... A46B 11/0027 401/175
4,974,984 A 12/1990 Kafkis
D376,048 S 12/1996 Gerhart
5,746,532 A * 5/1998 Megill ..... A46B 11/0027 401/175

(Continued)

FOREIGN PATENT DOCUMENTS

WO WO2007032660 A1 3/2007
WO WO2019114957 A1 6/2019

*Primary Examiner* — David J Walczak
(74) *Attorney, Agent, or Firm* — Mersenne Law

(57) ABSTRACT

A container for a viscous liquid, gel or paste-like substances has a closure integrated into its cap. The closure operates via a partial turn from open to closed, without separating into multiple parts. Even when open, one-way valves prevent the container contents from escaping until the flexible body of the container is squeezed to expel the contents. An outer surface of the closure is provided with brush bristles, and expelled container contents emerge among the bristles. The brush may be used to apply the expelled contents onto a surface. A separate cap may be provided to cover the bristles when the container is not in use. The bottle and a portion of the closure may be formed integrally. The bottle may have an arbitrary shape, such as a cartoon animal, and/or an opening to accept a carabiner for hanging the container.

19 Claims, 8 Drawing Sheets

(56) References Cited

U.S. PATENT DOCUMENTS

| | | | | |
|---|---|---|---|---|
| 6,457,891 | B1 | 10/2002 | Bredacts | |
| 6,675,812 | B1 | 1/2004 | Wiley | |
| D527,489 | S | 8/2006 | Angletta | |
| 7,794,168 | B2 | 9/2010 | Chang | |
| 8,651,763 | B2 | 2/2014 | Byun | |
| 8,920,059 | B2 | 12/2014 | Kravchenko | |
| 9,706,832 | B2 | 7/2017 | Price | |
| 10,595,616 | B2 | 3/2020 | Kravchenko | |
| 2004/0250386 | A1* | 12/2004 | Goldberg | F21L 4/005 24/601.5 |
| 2005/0232687 | A1 | 10/2005 | Zeh | |
| 2006/0130869 | A1 | 6/2006 | King | |
| 2008/0317544 | A1 | 12/2008 | Spirk | |
| 2009/0180825 | A1 | 7/2009 | Chang | |
| 2010/0294813 | A1 | 11/2010 | Delage | |

* cited by examiner

Fig. 1
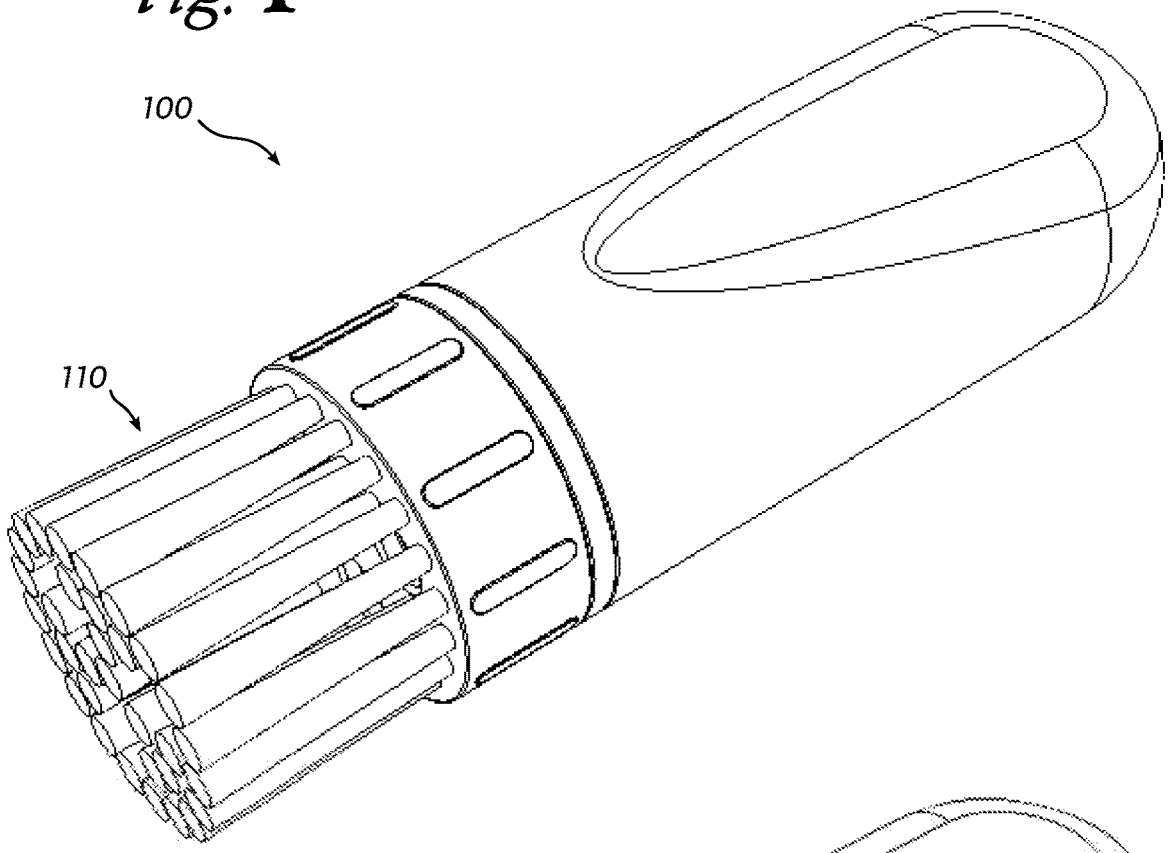
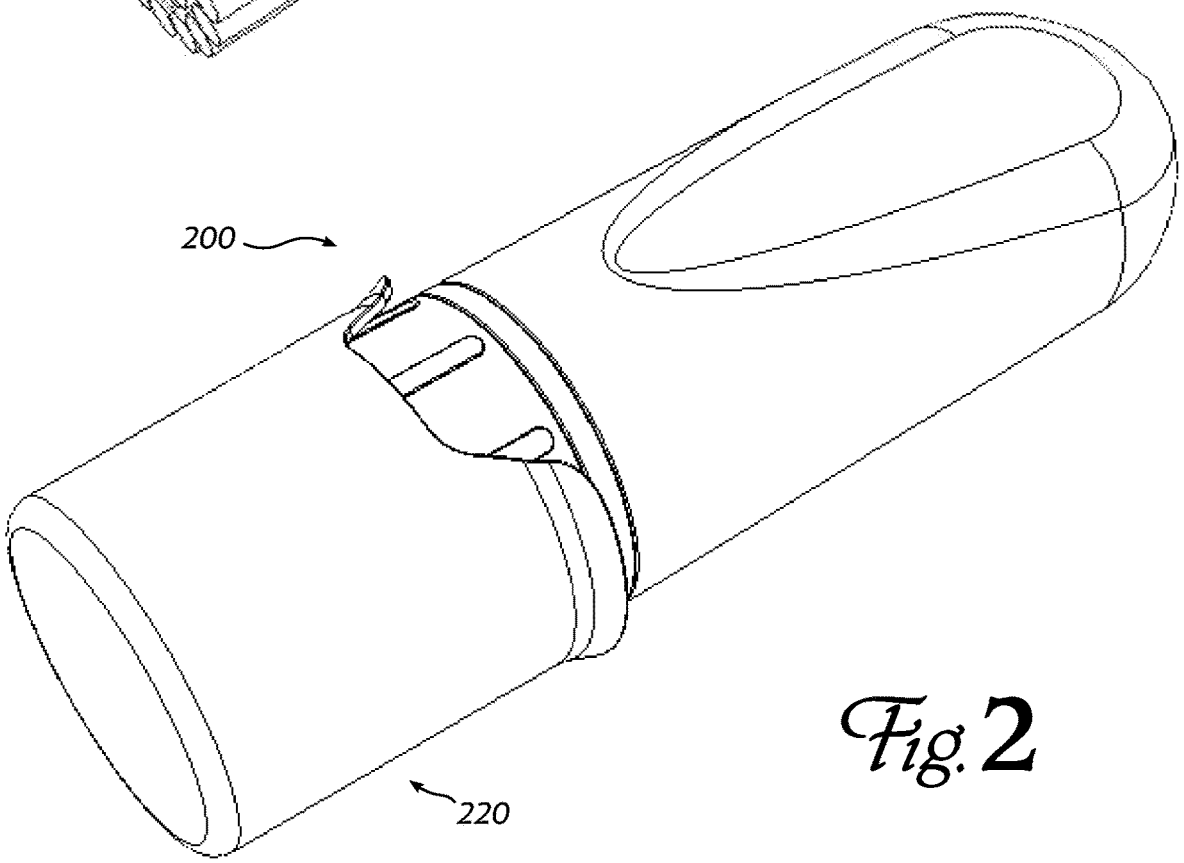
Fig. 2

CONTAINER WITH INTEGRATED DISPENSER AND APPLICATOR

CONTINUITY AND CLAIM OF PRIORITY

This is an original U.S. patent application.

FIELD

The invention relates to portable containers for viscous liquids, gels and similar materials, which incorporate valves to prevent unintentional dispensing of contents, brush-like structures to facilitate application of the contents, and other structural characteristics to improve convenience and handling of the containers.

BACKGROUND

While there are many different ways to apply sunscreen currently on the market (using hands, aerosol spray cans, wipes, powder brush, glide on stick and the like) there is no current sunscreen delivery device/product that uses liquid sunscreen for a touch free application. Aerosol cans, while offering a touch free spray, are not generally used to spray directly to the face as the spray can easily get into the eyes and ears. Aerosol spray also generally needs to be rubbed into the skin. Glide on sticks cannot be used over make up without smearing, and the same is true with wipes. Powder sunscreen with a brush while offering sun protection is expensive, requires a relatively large amount of the powder and reapplication is not easy, especially for the body. Getting a full coat is difficult with powder, as the American Academy of Dermatology recommends 1 oz. of liquid sunscreen for the face and body. There is a need in the industry to make the experience of applying liquid sunscreen a more pleasant, comfortable experience, especially for reapplication throughout the day with no mess or sticky hands.

An inexpensive container for liquid, paste or gel personal-care substances (e.g. sunscreen) that is easier to open, close and manipulate may be of significant value in this field.

SUMMARY

Embodiments of the invention are containers for a personal-care substance, which include a flexible bottle to hold the personal-care substance and a cylindrical closure having an "open" position and a "closed" position, where the personal-care substance is prevented from escaping the container when the closure is in the "closed" position. Brush bristles are disposed on an exterior surface of the cylindrical closure, and the personal-care substance flows among the bristles when the closure is opened. Several alternative arrangements for constructing such containers are described and claimed.

BRIEF DESCRIPTION OF DRAWINGS

FIG. 1 shows a container with brush according to an embodiment of the invention.

FIG. 2 shows the container and brush, with a cap covering the bristles of the brush.

DETAILED DESCRIPTION

The present invention is a combination sunscreen bottle with a makeup applicator brush. In a preferred embodiment, the invention includes a silicone container with rotating cover that that contains tufted brush bristles molded into or otherwise affixed with the lid. Inverted one-way valves in the lid allow a liquid sunscreen within the container to flow through to the bristles from the bottle for application to the body and face. The entire cap twists off of the silicone container for refilling the liquid sunscreen of choice. Within the cap is a twisting/locking mechanism to prevent leakage. The bristles are then covered by a cap to keep the brush and surrounding items in a bag or purse clean.

A container according to an embodiment of the invention has a flexible bottle-like portion and a separable closure with brush bristles on its front surface. The closure is operative to open and close the container by means of a partial turn of one portion of the closure with respect to another portion. The closure includes one-way valves to prevent the container contents from exiting the container freely when the partial-turn closure is opened—the contents can only be expressed when the partial-turn closure is open and the flexible bottle is squeezed to expel the contents, which saturate the bristles and can then be painted or spread over the skin. Many embodiments include a cap to cover the bristles when the container is not in use.

FIG. 1 shows a perspective view of an embodiment of the invention (generally at 100), which includes a flexible bottle for carrying and dispensing a lotion, gel or paste-like substance. An embodiment has brush bristles 110 for spreading the container's contents on the skin. The container can be opened and closed by a partial-turn closure mechanism, which does not separate from the container during ordinary use. (The entire closure structure may be removed so that the container can be refilled.) As shown in FIG. 2, the container (generally at 200) may include a separable cap 220 to cover the bristles and keep them clean when the container is stored.

Figure 3:
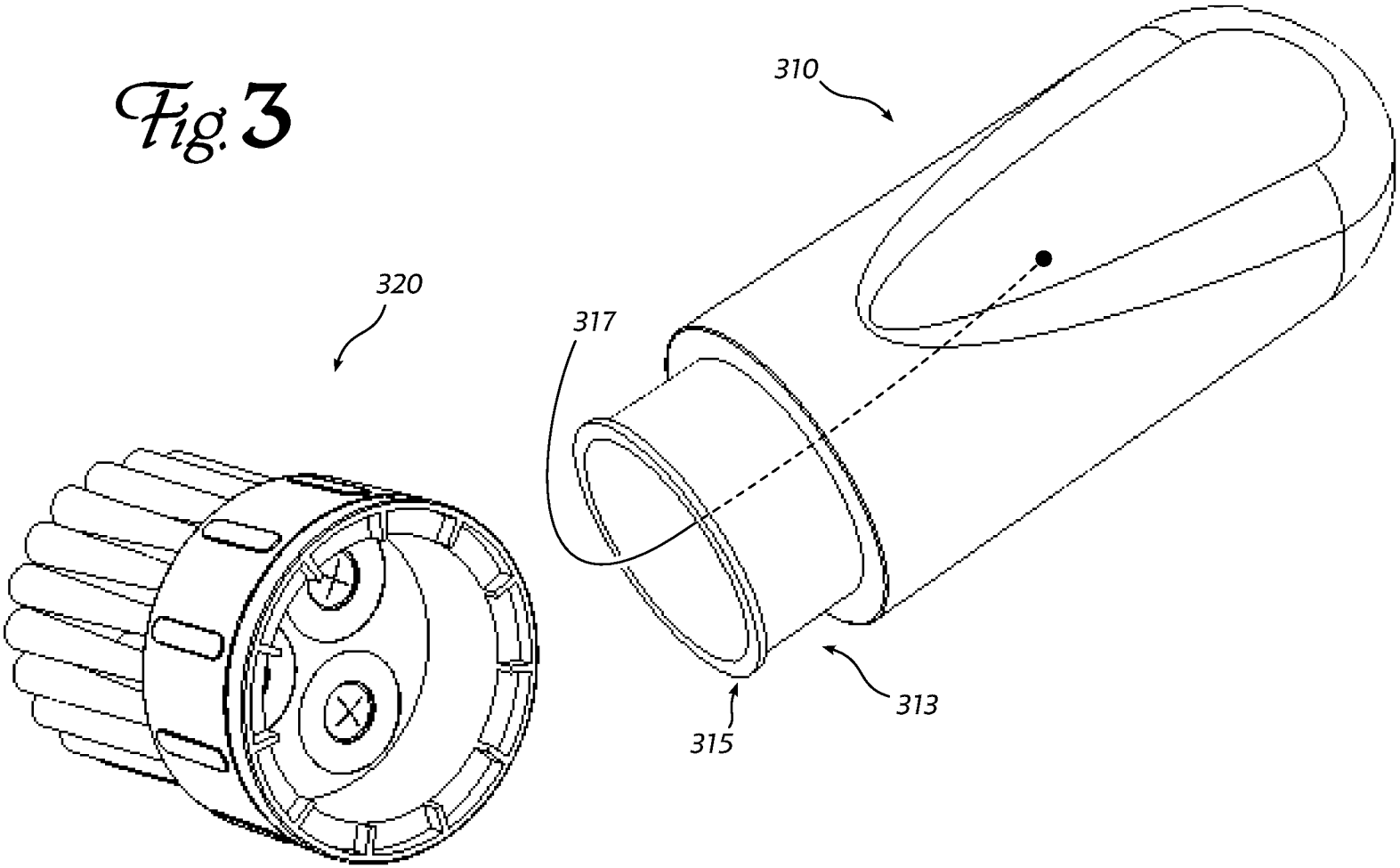
FIG. 3 shows a container according to an embodiment with the container and brush structures separated.

FIG. 3 shows an embodiment separated into its two main portions: a flexible bottle 310 and a brush head 320. The bottle of this embodiment has a cylindrical collar 313 with a lip 315 which holds the brush head 320 in place when the container is assembled. The interior volume of the bottle 317 is accessed through the opening in the neck. The brush head 320 comprises an integrated partial-turn closure mechanism. The bottle portion may be any shape and of a suitable volume considering the substance it is suited to contain, but the shape shown in FIG. 3 is preferred for reasons that will be described next.

Figure 4:
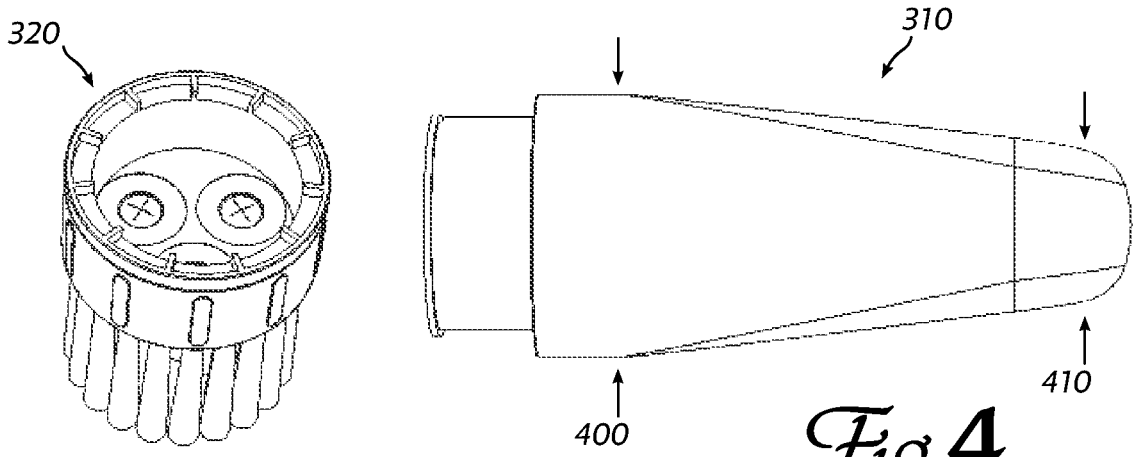
FIG. 4 shows the container and brush in another orientation.
Figure 5:
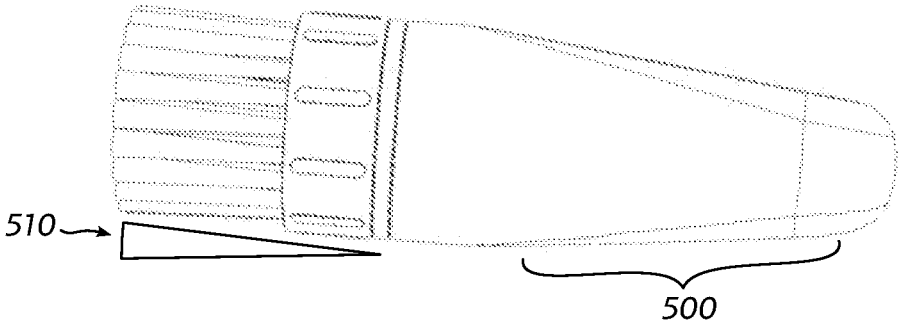
FIG. 5 shows how a preferred container shape provides beneficial handling characteristics.

FIG. 4 shows the bottle 310 and brush head 320 separated and from a different perspective; here, the portion of the bottle near the brush head has a first diameter 400, while the portion of the bottle distal to the brush head has a smaller thickness 410. The bottle may be strictly conical, or it may be a flattened cone as seen in FIGS. 1-3. The significant effect of the narrower or flatter portion distal to the brush head is shown in FIG. 5. The shape shown and described here allows the embodiment to rest on a surface on the flat portion of the bottle at 500, while the brushes are lifted up and away from the surface, 510. This helps prevent cross-contamination between the surface and the brush bristles (which may become coated with the product in the container during use).

Figure 6:
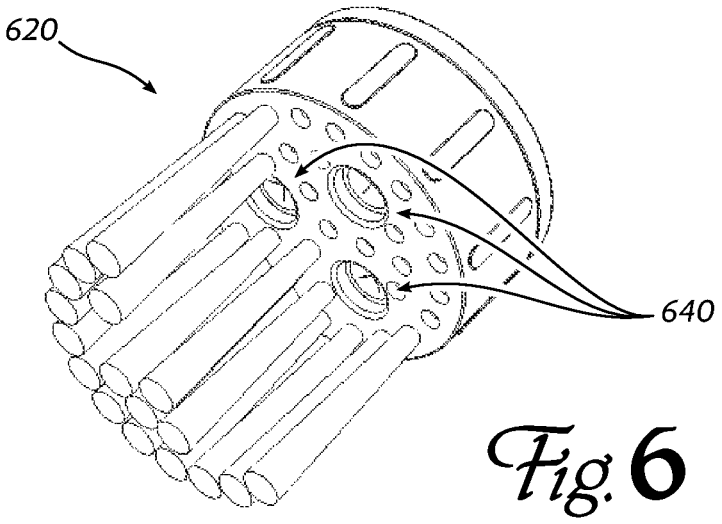
FIG. 6 shows a detail of the brush head, with several bristle bunches removed for clarity of illustration.

FIG. 6 shows the brush head of an embodiment 620, with several bristle tufts removed to show three symmetrically-placed openings at 640. The openings are placed among the brush bristles, so that when container contents are squeezed out, the contents flows out and coats the bristles. The bristles can then be used to "paint" or apply the material on the user's skin. The bristles may be of natural or artificial fibers, similar to a traditional makeup brush; or they may include "fingers" (a rod-like cylinder thicker than a typical hair or whisker, but still relatively small in diameter—preferably 1-3 mm) and made of a silicone or other material. A bristle that does not absorb the material in the container is preferred as it will not waste material forming the coating, and the brush is easier to clean. Since the bristles are used to paint or spread the container's contents on the skin, a softer bristle material is often preferred.

Figure 7:
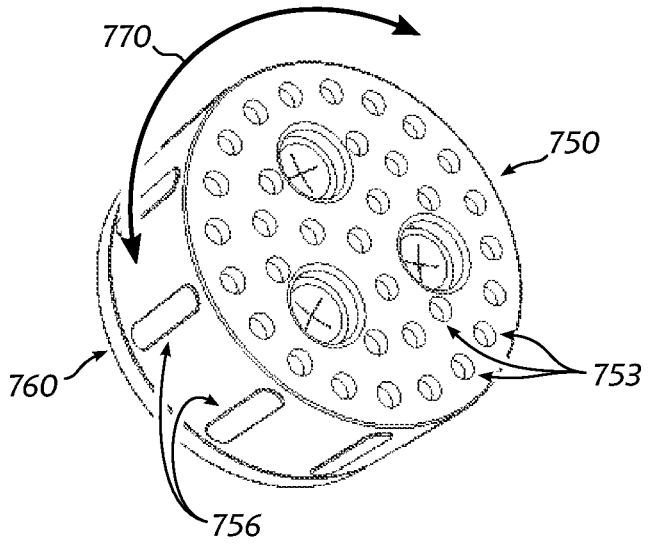
FIG. 7 shows another detail of the brush head with all bristles removed for clarity of illustration.

FIG. 7 shows the front surface of the brush head. At this level of detail, the brush head comprises a front part 750 and a back part 760 (only a thin ring of the back part is visible in this view). The front part and the back part can rotate relative to each other as shown by arrow 770. All of the bristles have been removed in this illustration for clarity, so the indentations or sockets 753 where the bristles were placed are visible. An embodiment may include small protrusions 756 on the outer surface of the front part of the brush head to help the user grasp the front part of the brush head and turn it.

Figure 8:
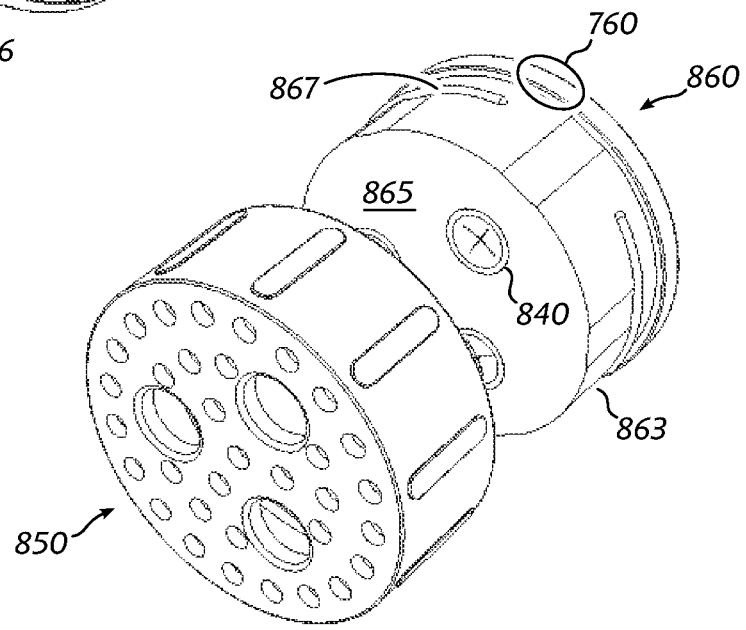
FIG. 8 is a first front perspective exploded view of the brush head.

In FIG. 8, the front part of the brush head 850 is separated from the back part, 860. The thin ring that was visible at 760 in FIG. 7 can be seen as the back edge of a roughly cylindrical structure 863 that fits inside the front part 850. A front surface of this cylinder 865, has three valves on its face. One valve is identified at 840. Also visible in this view is a channel 867 which partially encircles the cylinder. A protrusion inside the front part of the brush head travels in this channel, so the front part and the rear part can be rotated with respect to each other over an angle set by a length of the channel.

Figure 9:
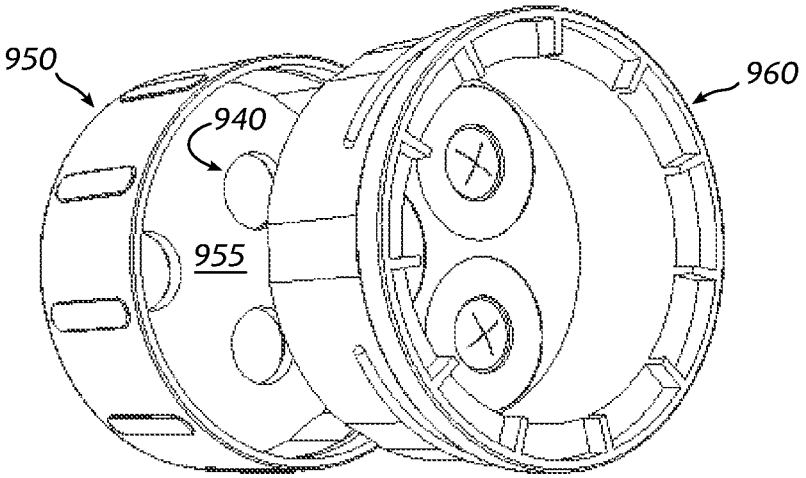
FIG. 9 is a rear perspective exploded view of the brush head.

FIG. 9 shows the front and rear parts of the brush head, 950 and 960, illustrated from a different angle. The front surface of the back part (865 in FIG. 8) is adjacent the back surface of the front part, 955, when the front and back parts are assembled. The front part has three openings therethrough, one of which is identified as 940.

Figure 10:
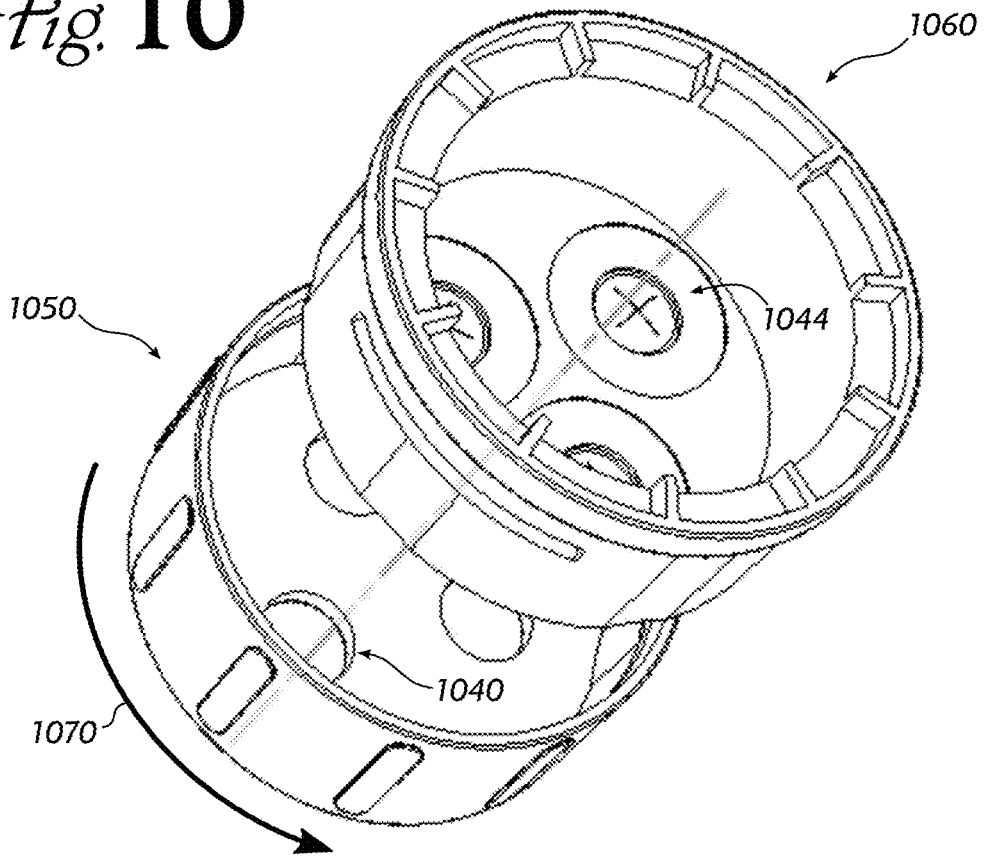
FIG. 10 shows how the container may be opened and closed.

FIG. 10 shows how the front and rear parts of the brush head 1050, 1060 cooperate to open and close the container. When holes 1040 align with valves 1044, the container's contents can be squeezed through the valves and exit among the bristles. When the front part of the brush head is rotated with respect to the back part (1070) so that the holes 1040 do not align with valves 1044, the container contents cannot be squeezed out, so the container is closed. Thus, opening and closing the container is accomplished by a partial turn of the front part of the brush head with respect to the back part (the back part is secured to the flexible bottle).

The embodiments depicted in these figures have three symmetrically-placed valves and holes, so these are at about 120° angles from the central axis of the brush head. If the front and back parts of the brush head rotate about 60°, then the container can be opened and closed with a partial turn. In embodiments wherein the brush head has four symmetrically-placed valves and holes (at about 90°) then a 45°-degree turn is sufficient to open and close the container. Generally speaking, n valves and corresponding openings can be placed symmetrically at 3607*n*, and a rotation of 360°/(2×n) is enough to open and close the container.

Figure 11:
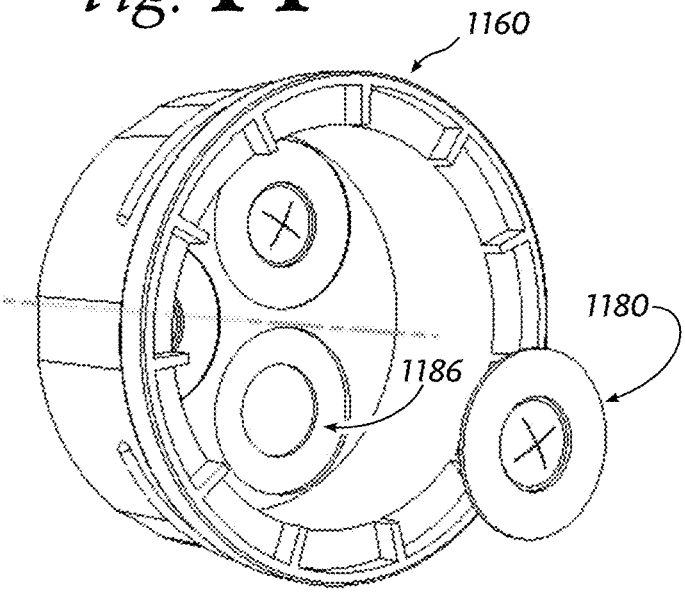
FIG. 11 is a detail of a rear component of the brush head.

FIG. 11 shows the back portion of the brush head, 1160, from which one of the three one-way valves 1180 has been removed from its seat 1186. Each one-way valve is a thin, flexible membrane having one or more slits formed therein. The valve is stiff enough to hold the container's contents back until the container is squeezed to force the contents through the valves. If the valves are aligned with the holes in the front part of the brush head, then the contents will pass through the holes and coat the bristles.

Figure 12:
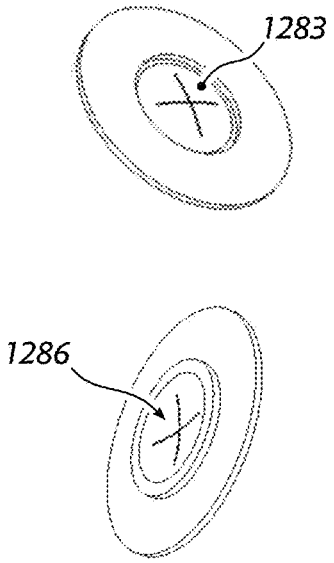
FIG. 12 shows inner and outer surfaces of a valve that may be used in an embodiment.

FIG. 12 shows the front and back surfaces of a one-way valve. The back surface—the surface that faces the container interior volume and the contents there—is convex (1283). The front surface—the surface that faces the back face 955 of the front part 950—is concave (1286). When the front cover openings and the valves are aligned, and the container is squeezed, the petals of each valve evert to allow the container contents to flow therethrough. When the pressure is relaxed, the valve petals return to their convex/concave positions to prevent further material from flowing out.

The foregoing description and figures (principally FIGS. 1-10) show various aspects of similar embodiments of the invention. A closeable container according to an embodiment of the invention comprises a flexible bottle portion (which may be of a shape similar to those shown, or of a different shape), and a roughly cylindrical partial-turn closure mechanism (see, e.g., FIG. 8). The closure mechanism comprises two main parts: an outer cylinder with one open face and one mostly-closed face, and an inner cylinder with one open face and one mostly-closed face. Both mostly-closed faces have a plurality of openings formed through them, and when the inner cylinder is assembled inside the outer cylinder with the circular, mostly-closed faces adjacent each other, the cylinders can be rotated to align the openings. When so aligned, the closure mechanism is "open" and container contents can pass through the aligned openings. When the cylinders are rotated so that the openings are not aligned, the closure mechanism is "closed" and container contents cannot escape.

Figure 13:
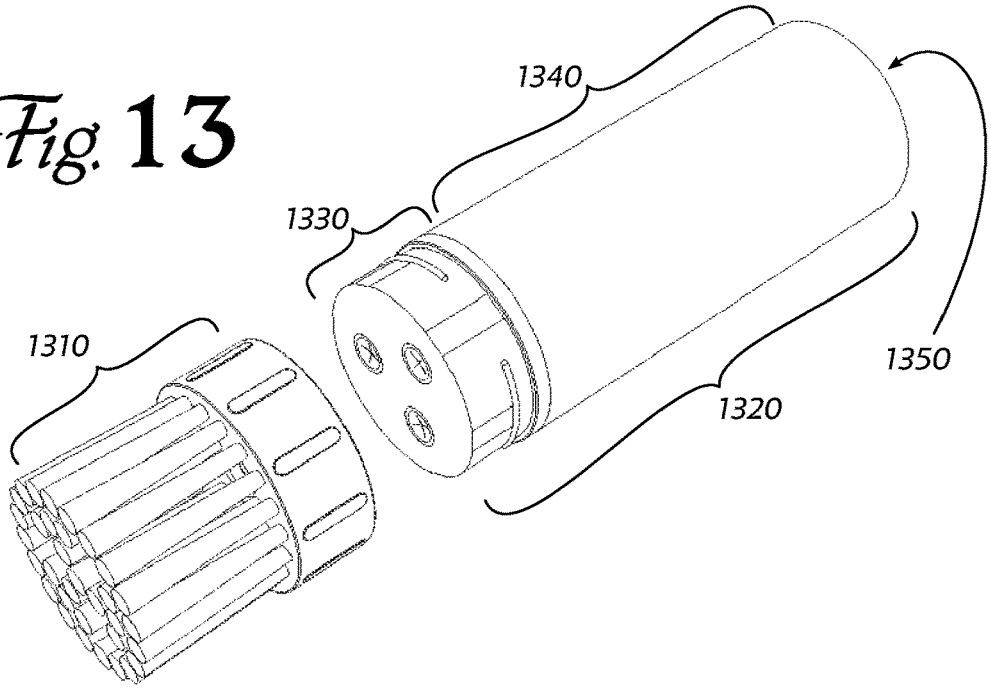
FIG. 13 shows a partly-exploded view of an alternate embodiment of the invention.

The inner cylinder with mostly-closed front face (FIG. 8, 860; FIG. 9, 960) is removably secured to the flexible bottle in the embodiments depicted so far, but it can also be formed contiguously or integrally in a single mold with the bottle portion (the bottle's rear end is left open for filling with product, after which the end is sealed shut with heat, ultrasonic welding, or another suitable technique). FIG. 13 shows the principal parts of this arrangement: the brush head 1310 is similar to prior embodiments, but the bottle portion 1320 comprises a brush-back or inner-cylinder portion 1330 formed contiguously with a cylindrical bottle portion 1340. In this arrangement, the mostly-closed face of the inner cylinder is produced with integrally-formed one-way valves, rather than separate valve membranes as shown in FIGS. 10, 11 and 12.

Figure 14:
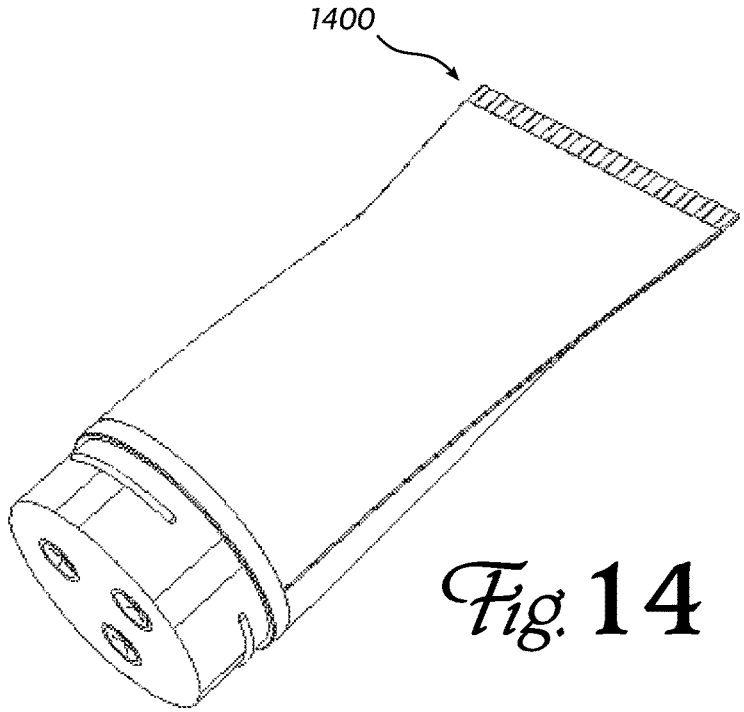
FIG. 14 shows the "bottle" portion of the alternate embodiment after filling, illustrated with the brush bristles omitted for clarity.
Figure 15:
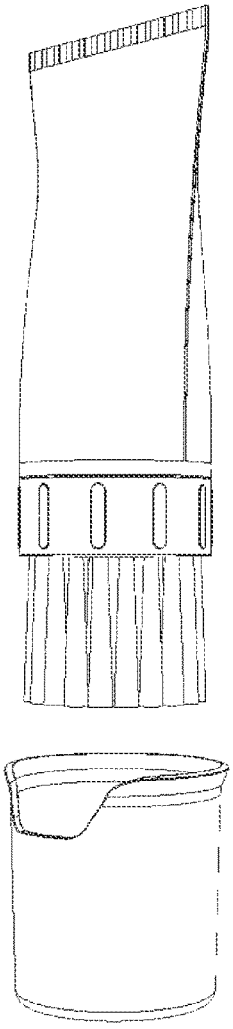
FIG. 15 shows an assembled view of the alternate embodiment, the cap exploded away from the container and brush bristles.

The rear portion of this alternate embodiment, 1320, is filled with the lotion, gel or paste substance through the open end 1350. Then, the rear opening is closed and sealed (e.g. by heat sealing, ultrasonic welding, or the like) as shown in FIG. 14 at 1400. The filled rear portion is assembled with a brush head and cap to produce a finished container according to an embodiment, illustrated in FIG. 15.

It is appreciated that the shape of the bottle portion of this alternate embodiment is similar to the "flattened cone" shape of earlier embodiments, so it also possesses the ease-of-use benefit described with reference to FIG. 5.

Figure 16:
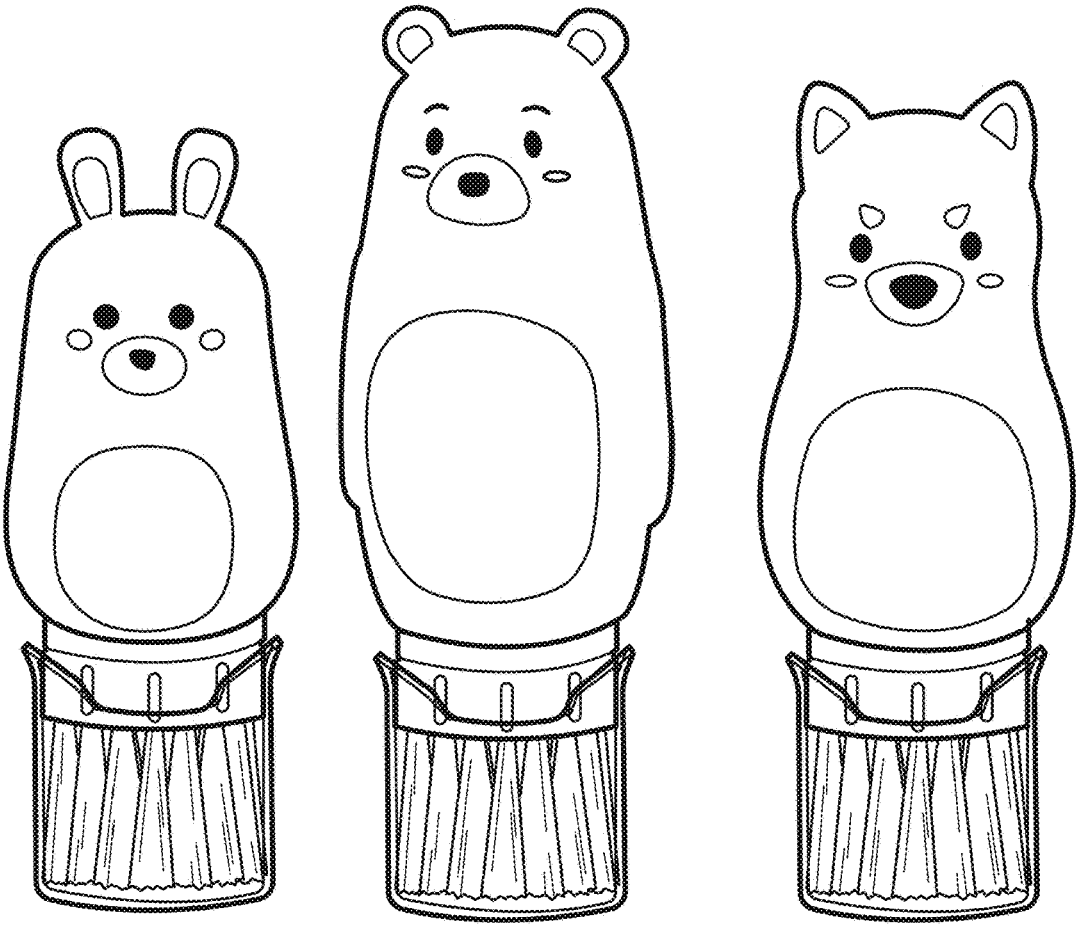
FIG. 16 shows several alternate bottle shapes that may be used with an embodiment.
Figure 17:
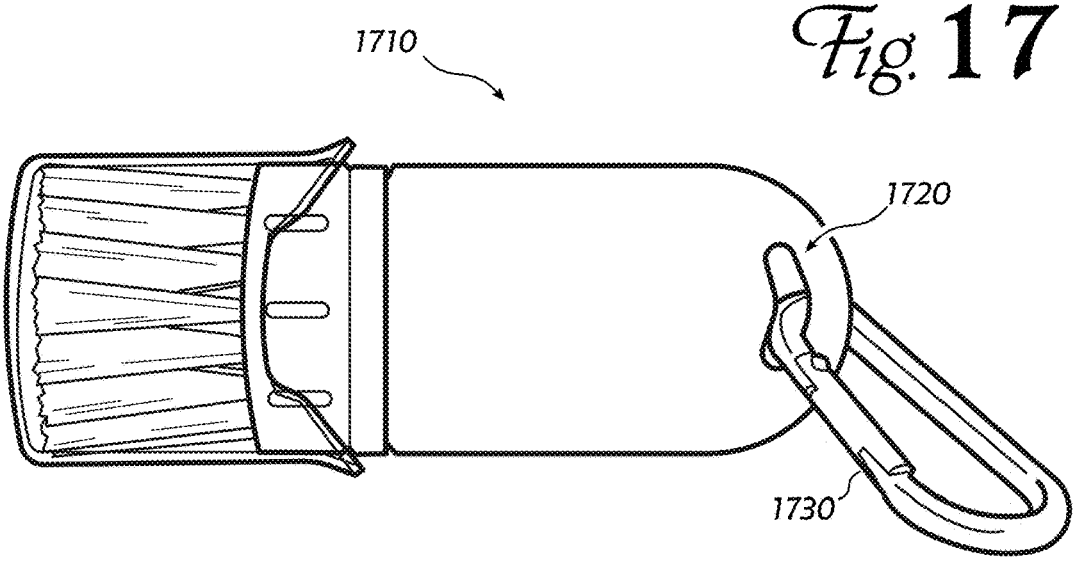
FIG. 17 shows another alternate bottle configuration.
Figure 18:
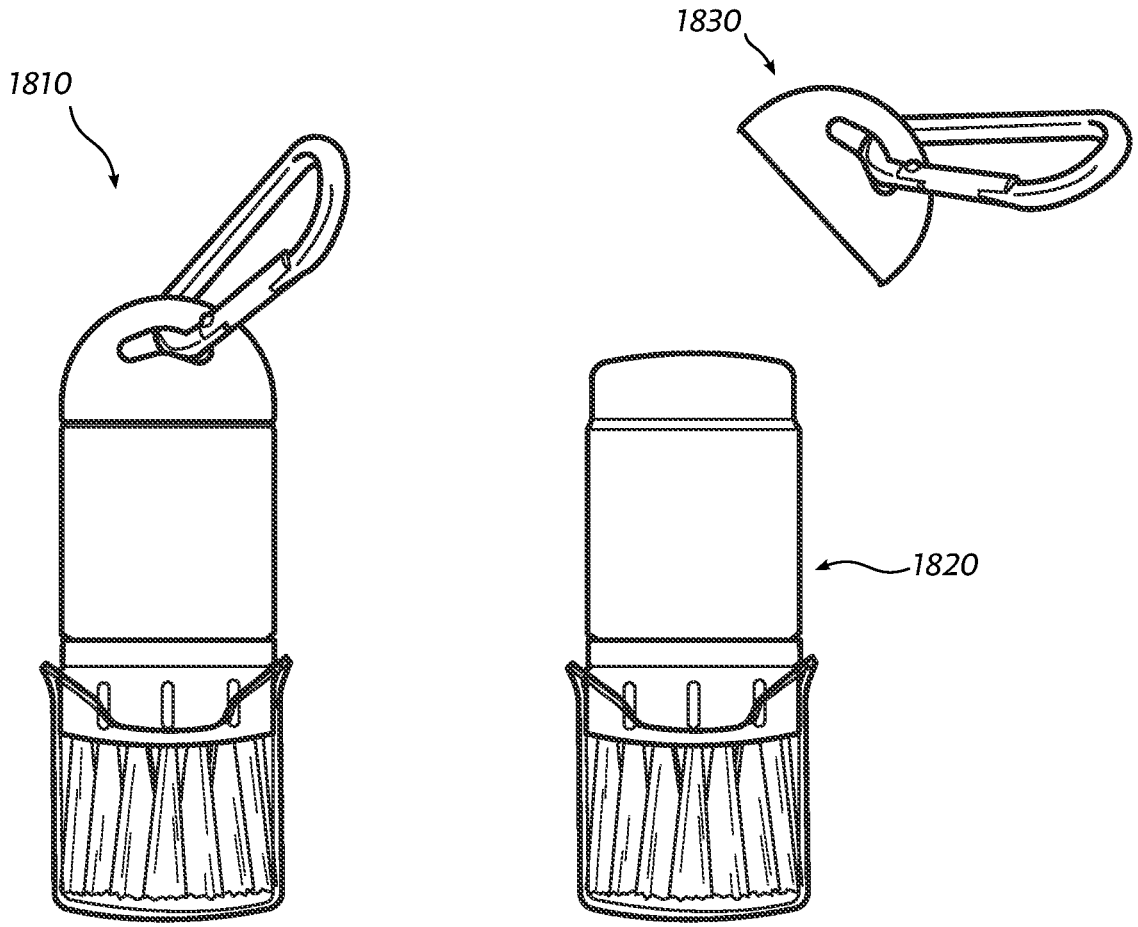
FIG. 18 shows an additional bottle feature that may be present in an embodiment.

Other bottle shapes may be used with a partial-turn closure and brush applicator according to an embodiment of the invention. Three example bottle shapes are shown in FIG. 16. FIG. 17 shows another bottle shape, 1710, with an opening 1720 at the rear that can accept a carabiner 1730 so that the bottle may be hung from a loop or strap. FIG. 18 shows that the carabiner-and-bottle embodiment of FIG. 17 may be configured 1810 so that the rear of the bottle and the carabiner, 1830, are separable from the brush, bottle and contents 1820. In this embodiment, the carabiner holds the rear cap in place (on a loop or strap) while the bottle is manipulated to apply the contents using the brush. When application is completed, the bottle would be clicked back into the rear cap for storage.

The applications of the present invention have been described largely by reference to specific shapes and arrangements of component structures. However, those of skill in the art will recognize that the benefits of an embodiment can also be realized in a design combining a bottle and a brush that allows liquid sunscreen to be applied on the body and face, where the container is sized, shaped or configured somewhat differently than herein described. Such alternate sizes, shapes and configurations are understood to be captured according to the following claims.

I claim:

1. A container for a personal-care substance comprising:

a flexible bottle to hold the personal-care substance, the bottle having an opening;

a cylindrical cover detachably connected to the flexible bottle and positioned over the opening, said cylindrical cover comprising a front component having a flat front face with a front plurality of openings and a rear component having a flat rear face with a rear plurality of openings, the cylindrical cover configured to hold the flat front face adjacent the flat rear face; and a plurality of bristles disposed on an exterior surface of the cylindrical cover, wherein the cylindrical cover has a first position which aligns the front plurality of openings with the rear plurality of openings so that squeezing the flexible bottle expresses the personal-care substance among the plurality of bristles, and the cylindrical cover has a second position which misaligns the front plurality of openings with the rear plurality of openings so that squeezing the flexible bottle does not express the personal-care substance among the plurality of bristles.

2. The container of claim 1, further comprising:

a removable cap to cover the plurality of bristles.

3. The container of claim 1 wherein the cylindrical cover comprises:

an outer cylindrical portion having one open end and one mostly-closed end, said mostly-closed end forming the flat front face and wherein the front plurality of openings are an outer plurality of regularly-spaced openings formed through the mostly-closed end; and a concentric inner cylindrical portion having one open end and one mostly-closed end, said mostly-closed end forming the flat rear face and wherein the rear plurality of openings are an inner plurality of regularly-spaced openings formed through the mostly closed end, wherein the inner cylindrical portion is assembled within the outer cylindrical portion so that the mostly-closed end of the inner cylindrical portion is adjacent the mostly-closed end of the outer cylindrical portion, and the inner cylindrical portion can rotate over a partial turn relative to the outer cylindrical portion.

4. The container of claim 3, further comprising:

a plurality of one-way valves, each located in a corresponding one of the inner plurality of regularly-spaced openings, the one-way valves together operative to prevent the personal-care substance from passing through the one-way valves and openings unless the flexible bottle is compressed.

5. The container of claim 1 wherein the flexible bottle has a flattened conical shape with a larger base diameter near the cylindrical cover and a reduced thickness distal to the cylindrical cover.

6. The container of claim 1 wherein the flexible bottle is a silicone bottle.

7. The container of claim 1 wherein the plurality of bristles are natural make-up bristles.

8. The container of claim 1 wherein the plurality of bristles are synthetic make-up bristles.

9. The container of claim 1 wherein the plurality of bristles are silicone fingers having a diameter between 1 mm and 3 mm.

10. A container for a personal-care substance comprising:

a flexible bottle having an opening into an interior volume, said interior volume to contain a personal-care substance; and a cover detachably connected to the flexible bottle and positioned over the opening, said cover having an integral closure function to open and close the container, and a plurality of bristles on an exterior surface of the cover, wherein when the integral closure function of the cover is in an open position, applying pressure to the flexible bottle causes the personal-care substance to exit the flexible bottle and travel through the cover to reach the plurality of bristles, wherein the integral closure function is provided by a two-piece closure mechanism comprising:

a front closure having a flat front surface; and a rear closure having a flat rear surface, said flat front surface and flat rear surface adjacent each other in the two-piece closure mechanism, wherein the front closure rotates relative to the rear closure around an axis of rotation for a partial turn, when the front closure is in a first position relative to the rear closure, the personal-care substance is impeded from escaping from the flexible bottle, and when the front closure is in a second, different position relative to the rear closure, the personal-care substance may be squeezed out from the flexible bottle and travel through rear openings in the flat rear surface of the rear closure and then through front openings in the flat front surface of the front closure before reaching the plurality of bristles.

11. The container of claim 10 wherein the rear closure further comprises:

a plurality of one-way valves at the rear openings, said one-way valves being operative to prevent the personal-care substance from exiting the bottle when the front closure is in the second and different position relative to the rear closure unless the pressure is applied to the flexible bottle.

12. The container of claim 10 wherein a number of front openings is an integer number n, a number of rear openings is an equal integer number n, and the partial turn is 360°/(2×n) of rotation.

13. The container of claim 10 wherein the bristles consist of one of a plurality of natural fibers, a plurality of artificial fibers, or a plurality of silicone rods having a diameter from 1 mm to 3 mm.

14. The container of claim 10 wherein the flexible bottle is shaped like an animal.

15. The container of claim 10 wherein the flexible bottle comprises an opening at an end remote from the cover, said opening adapted to accept a carabiner for hanging the container.

16. The container of claim 10 wherein the flexible bottle comprises a rear cap removably secured to the flexible bottle at a point distant from the plurality of bristles, said rear cap having an opening adapted to accept a carabiner for hanging the container.

17. A sunscreen container and applicator comprising:

a flexible bottle secured to a rotatable closure having an applicator brush on an exterior face thereof, wherein the rotatable closure is detachably connected to the flexible bottle and positioned over the opening, wherein the rotatable closure brings two flat circular surfaces together, each flat circular surface having a similar plurality of openings positioned symmetrically over the flat circular surface, wherein when the rotatable closure is in a closed position, a first plurality of openings in a first flat circular surface of the two flat circular surfaces do not align with a second plurality of openings in a second flat circular surface of the two flat circular surfaces, and when the rotatable closure is in an open position, the first plurality of openings in the first flat circular surface align with the second plurality of openings in the second flat circular surface so that sunscreen in the flexible bottle may be squeezed through the aligned first plurality of openings and second plurality of openings and emerge on the applicator brush.

18. The sunscreen container of claim 17 wherein the flexible bottle is formed integrally with the second flat circular surface having the second plurality of openings, said second plurality of openings having one-way valves formed therein concurrently with the flexible bottle and the second flat circular surface.

19. The sunscreen container of claim 18 wherein the flexible bottle formed integrally with the second flat circular surface is a flexible bottle having an open end distal to the second flat circular surface, and wherein the open distal end is sealed after the flexible bottle is filled with sunscreen through the open distal end.

* * * * *